US005572774A

United States Patent [19]

Duren

[11] Patent Number: 5,572,774

[45] Date of Patent: Nov. 12, 1996

[54] SHOE FASTENING ATTACHMENT DEVICE

[76] Inventor: Russell B. Duren, 3750 SW Masilunas St., Port St. Lucie, Fla. 34953

[21] Appl. No.: 343,619

[22] Filed: Nov. 22, 1994

[51] Int. Cl.[6] ..... A43B 11/00; A43C 9/00

[52] U.S. Cl. ..... 24/306; 36/50.1; 24/302; 24/714.8

[58] Field of Search ..... 24/306, 442, 445, 24/450, 302, 90.1, 379.1, 713, 713.1, 712.1, 712.2, 713.6, 715, 715.2; 36/50.1

[56] References Cited

U.S. PATENT DOCUMENTS

| | | | |
|---|---|---|---|
| Re. 32,585 | 2/1988 | Antonious | 24/306 X |
| 1,271,259 | 7/1918 | Auerbach | 24/302 |
| 1,571,494 | 2/1926 | Scott et al. | 24/302 |
| 3,205,544 | 9/1965 | Streule et al. . | |
| 3,550,218 | 12/1970 | Woolner . | |
| 4,282,657 | 8/1981 | Antonious | 24/306 X |
| 4,733,439 | 3/1988 | Gentry | 24/302 X |
| 4,907,352 | 3/1990 | Ginsberg | 24/306 X |
| 5,027,482 | 7/1991 | Torppey | 24/712.1 |
| 5,109,581 | 5/1992 | Gould | 24/714.8 X |
| 5,148,614 | 9/1992 | Kelly | 36/50.1 |
| 5,203,053 | 4/1993 | Rudd | 24/306 |
| 5,230,171 | 7/1993 | Cardaropoli | 36/50.1 |

*Primary Examiner*—Peter M. Cuomo
*Assistant Examiner*—Robert J. Sandy
*Attorney, Agent, or Firm*—Michael I. Kroll

[57] ABSTRACT

A shoe fastening attachment device comprising a buckle with a structure for mounting the buckle to a pair of eyelets on a first side flap of a shoe. An elongated flexible strap is provided, with a facility for mounting a first end of the elongated flexible strap to a pair of eyelets on an opposite second side flap of the shoe. Paraphernalia on an upper face of the elongated flexible strap is for releasably securing portions of the upper face together, after a second end of the elongated flexible strap is inserted through the buckle and the elongated flexible strap is looped back upon itself in an overlapping manner.

1 Claim, 2 Drawing Sheets

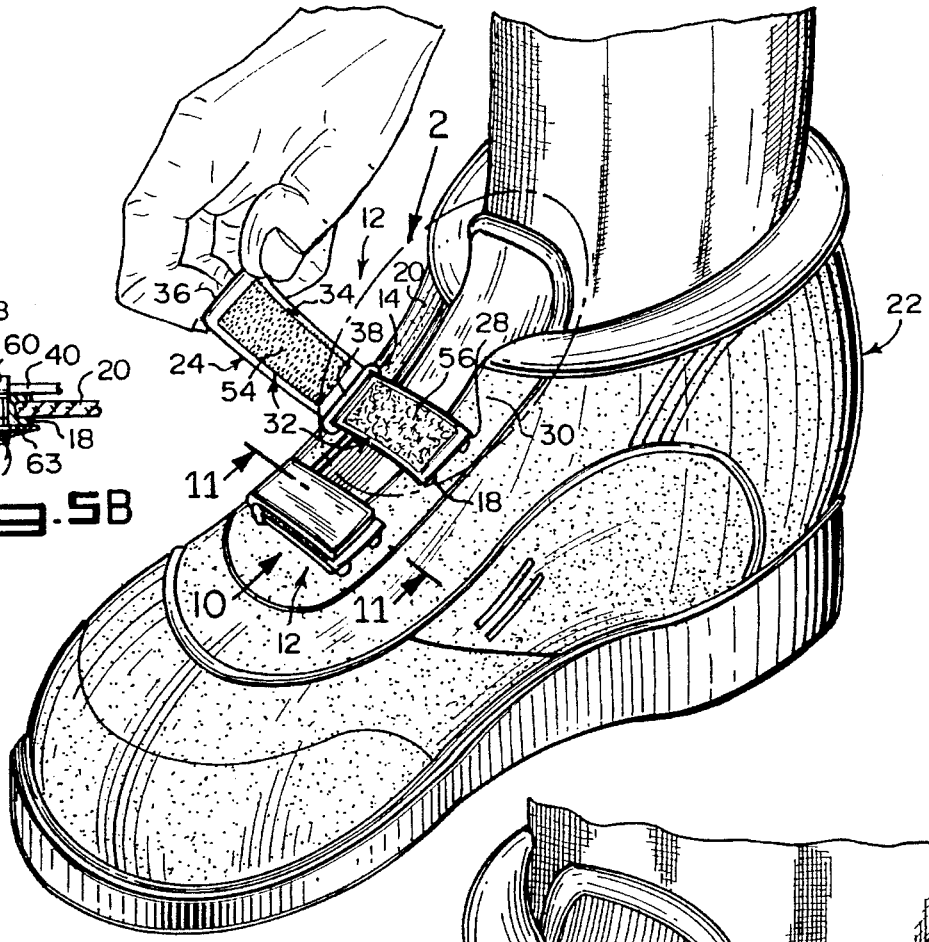
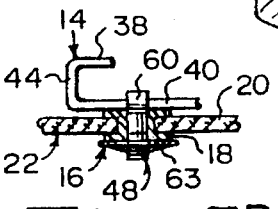
Fig. 5B
Fig. 1
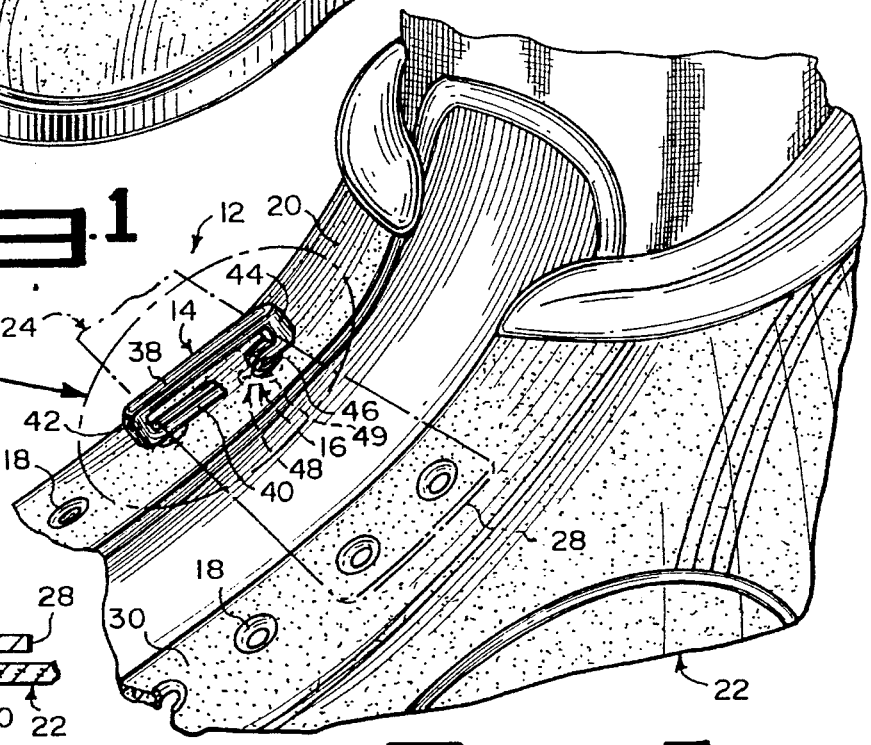
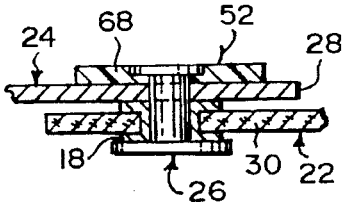
Fig. 11
Fig. 2

SHOE FASTENING ATTACHMENT DEVICE

BACKGROUND OF THE INVENTION

1. Field of the Invention

The instant invention relates generally to shoe closures and more specifically it relates to a shoe fastening attachment device.

2. Description of the Prior Art

Numerous shoe closures have been provided in prior art. For example, U.S. Pat. No. 3,205,544 to Streule et al.; U.S. Pat. No. 4,907,352 to Ginsberg; U.S. Pat. No. 5,027,482 to Torppey and U.S. Pat. No. 5,203,053 to Rudd all are illustrative of such prior art. While these units may be suitable for the particular purpose to which they address, they would not be as suitable for the purposes of the present invention as heretofore described.

The U.S. Pat. No. 3,205,544 of Streule et al. discloses a device for shoes for the adjustable connection of uppers provided with eyelets, comprising in combination at least two holding elements, one of each is connected detachably with one of the upper parts. Each of the holding elements is provided with a web and an adjusting strap fastened with one extremity on one of the holding elements and arranged with its other extremity as a loop around the web of the neighboring holding element. The adjusting strap is provided in the overlapping range with facings of self-adhering fabrics on the surfaces facing each other. The two holding elements are in the form of brackets. Each bracket includes rigid bracket arms and resilient inserting arms disposed in a plane parallel to the plane of the bracket arms. Perpendicular shoulders connect the bracket arms. Resilient inserting arms at corresponding ends thereof extend perpendicularly to the plane of the bracket arms. Laterally angled shoulders are adjacent the perpendicular shoulders. Each rigid bracket arm with its web is disposed on the exterior side of the upper and the inserting arms on the interior side thereof. The perpendicular shoulders extend perpendicularly to the plane of the bracket arms and are retained in the eyelets in the upper parts.

The U.S. Pat. No. 4,907,352 of Ginsberg. discloses a shoe lace replacing and shoe fastening device comprising a pair of eyelet members. Each member has a pair of spaced fasteners for securing one eyelet member to adjacent eyelets along one side of a shoe upper, after removal of the laces thereof, and for securing the other eyelet member to adjacent eyelets along the other side of a shoe upper. An elongated strip of VELCRO material is secured to the eyelet members and adapted to extend removably secure to itself whereby the shoe can be fastened without conventional laces.

The U.S. Pat. No. 5,027,482 of Torppey discloses a securing device for shoes includes a lace which cooperates with a shoe's eyelets. First and second tab members are secured to opposite end portions of the lace. The device may alternatively include a plurality of lace segments. The tab members include hook and loop-type strips which cooperate to releasably secure the two members together in any one of various adjusted positions.

The U.S. Pat. No. 5,203,053 of Rudd discloses a shoelace replacing and fastening device comprising an elongated strip, a strip insert and a clasp. Rivet fasteners are used to secure the clasp on one shoe eyelet and to secure the elongated strip to the opposite shoe eyelet of where the clasp is located. The elongated strip is made of a flexible plastic material and has openings for releasably receiving a strip insert at one end of the elongated strip. The strip insert is made of a relatively rigid but flexible plastic material. The elongated strip and the strip insert have a plurality of interlocking hook elements. The hook elements of the strip insert are designed to interlock with the plurality of hook elements of the elongated strip. The clasp is fastened on a shoe eyelet, and the elongated strip fastened on the opposite shoe eyelet to that of where the clasp is fastened. The elongated strip is put through the clasp. The interlocking hook elements of the strip insert are pressed against the hook elements of the elongated strip to secure a shoe on a foot.

SUMMARY OF THE INVENTION

A primary object of the present invention is to provide a shoe fastening attachment device that will overcome the shortcomings of the prior art devices.

Another object is to provide a shoe fastening attachment device which is an elongated flexible strap and buckle that replaces a shoelace in the shoe, by hooking into the existing eyelets in the shoe.

An additional object is to provide a shoe fastening attachment device, in which the elongated flexible strap will adjustably engage with the buckle to permit the securement of the shoe upon a foot of a person wearing the shoe.

A further object is to provide a shoe fastening attachment device that is simple and easy to use.

A still further object is to provide a shoe fastening attachment device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a shoe with the instant invention installed thereon.

FIG. 2 is an enlarged perspective view of the area indicated by arrow 2 in FIG. 1, showing the elongated flexible strap in phantom and the buckle broken away.

FIG. 5B a cross sectional view of a third modified buckle, showing push-on a washer style connector.

Figure 6:
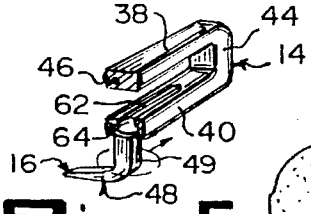

FIG. 6 is a perspective view of a portion of a fourth modified buckle with longitudinal adjustable swivel hooks.

Figure 4:
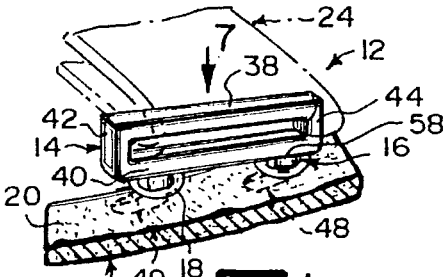
FIG. 4 is a perspective view similar to FIG. 3, showing the connectors of the buckle which are hooks inserted into the eyelets and the elongated flexible strap in phantom.
Figure 7:
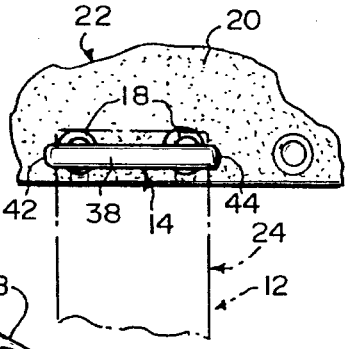

FIG. 7 is a top view taken in the direction of arrow 7 in FIG. 4.

Figure 8:
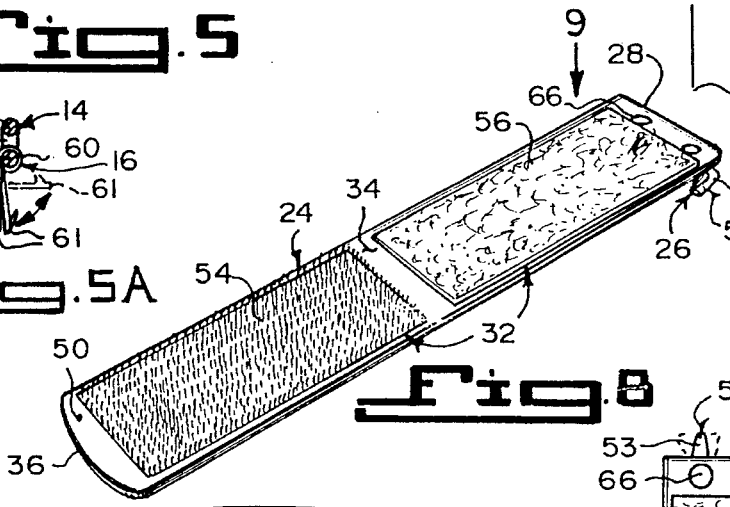

FIG. 8 is a perspective view of the elongated flexible strap per se in a flat extended position.

Figure 9:
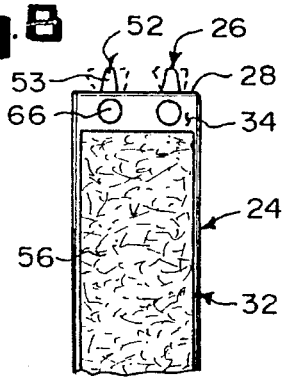

FIG. 9 is a top view of a portion of the elongated flexible strap taken in the direction of arrow 9 in FIG. 8, showing the couplers being pivoting curved members in greater detail.

Figure 10:
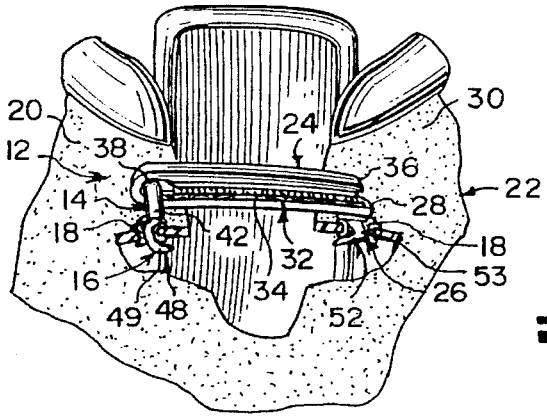

FIG. 10 is a perspective view taken in the direction of arrow 10 in FIG. 1, with parts of the shoe broken away for clarity.

FIG. 11 is a cross sectional view taken generally along line 11—11 in FIG. 1, showing one of the couplers on the elongated flexible strap as a button type snap style.

DETAILED DESCRIPTION OF THE PREFERRED EMBODIMENTS

Turning now descriptively to the drawings, in which similar reference characters denote similar elements throughout the several views, FIGS. 1 through 10 illustrate a shoe fastening attachment device 12 comprising a buckle 14 with a structure 16, for mounting the buckle 14 to a pair of eyelets 18 on a first side flap 20 of a shoe 22. An elongated flexible strap 24 is provided, with a facility 26 for mounting a first end 28 of the elongated flexible strap 24 to a pair of eyelets 18 on an opposite second side flap 30 of the shoe 22. Paraphernalia 32 on an upper face 34 of the elongated flexible strap 24, is for releasably securing portions of the upper face 34 together, after a second end 36 of the elongated flexible strap 24 is inserted through the buckle 14 and the elongated flexible strap 24 is looped back upon itself in an overlapping manner.

The buckle 14 includes long upper and lower segments 38, 40 and short side segments 42, 44. The buckle 14 is fabricated out of a strong durable metal material 46. The elongated flexible strap 24 is rectangular and fabricated out of a cloth material 50. The releasably securing paraphernalia 32 includes mating hook and loop pile fastener material pads 54, 56 affixed in a side by side arrangement on the upper face 34 of the elongated flexible strip 24.

The buckle mounting structure 16, shown in FIGS. 2, 3, 4, 5, 5A, and 6, consists of a pair of spaced apart connectors 48 on the long lower segment 40 of the buckle 14. The connectors 48 will fit into and engage with the pair of eyelets 18 on the first side flap 20 of the shoe 22. The strap, shown in FIGS. 8, and 9, consists of a pair of spaced apart couplers 52 on the first end 28. The couplers 52 will fit into and engage with the pair of eyelets 18 on the second side flap 30 of the shoe 22.

Figure 3:
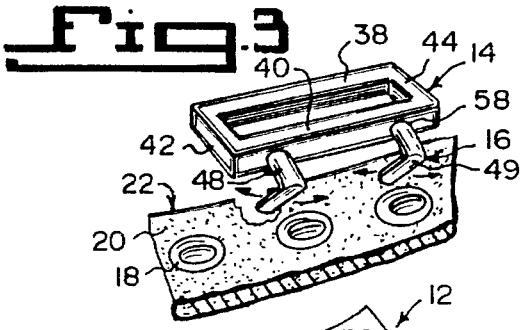
FIG. 3 is a perspective view of the area indicated by arrow 3 in FIG. 2 from the opposite side, showing the connectors of the buckle which are hooks ready to be inserted into the eyelets in the shoe.

Each connector 48 on the long lower segment 40 of the buckle 14, as best seen in FIGS. 3 and 4, is a hook 49, pivotally retained with a pivot pin 58 thereto. Each hook 49 can swivel in an adjustable manner to make contact with the eyelets 18 in different spaced apart relationships on the first side flap 20 of the shoe 22.

Figure 5:
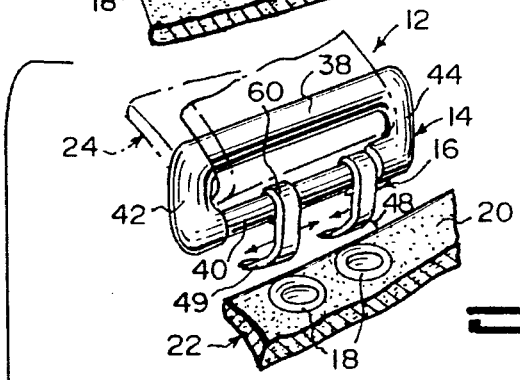
FIG. 5 is a perspective view similar to FIG. 3, of a first modified buckle in which the connectors are longitudinal adjustable hooks and the elongated flexible strap shown in phantom.

Each hook 49 on the long lower segment 40 of the buckle 14, as shown in FIG. 5, is retained with a loop 60. Each hook 49 can slide in an adjustable manner on a cylindrical portion of the long lower segment 40, to make contact with the eyelets 18 in different spaced apart relationships on the first side flap 30 of the shoe 22.

Figure 5A:
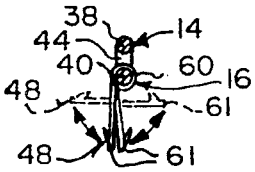
FIG. 5A is a cross sectional view of a second modified buckle showing a double wing barb style connector.

In FIG. 5A, each connector 48 on the long lower segment 40 of the buckle 14 is of a double wing barb style 61. The double wing barb style 61 can also be utilized for the couplers 52 of the elongated flexible strap 24. As shown in FIG. 5B, each connector 48 on the long lower segment 40 of the buckle 14 is of a push-on washer style 63. The push-on washer style 63 can also be utilized for the couplers 52 of the elongated flexible strap 24.

As shown in FIG. 6, the long lower segment 40 of the buckle 14 has a longitudinal track slot 62 therein. Each hook 49 has a disc-shaped head 64 to ride in the track slot 62. Each hook member 49 can swivel and slide in an adjustable manner to make contact with the eyelets 18 in different spaced apart relationships on the first side flap 20 of the shoe 22.

In FIGS. 8 and 9, each coupler 52 on the first end 28 of the elongated flexible strap 24 is a curved member 53 that is pivotally retained with a rivet 66. Each curved member 53 can swivel in an adjustable manner to make contact with the eyelets 18 in different spaced apart relationships in the second side flap 30 of the shoe 22. Each coupler 52 on the first end 28 of the elongated flexible strap, as shown in FIG. 11, can also be of a button type snap style 68.

OPERATION OF THE INVENTION

To use the shoe fastening attachment device 12, the following steps should be taken:

1. Insert the connectors 48 of the buckle 14 into the eyelets 18 in the first side flap 20 of the shoe 22.
2. Engage the couplers 52 of the elongated flexible strap 24 into the eyelets 18 in the second side flap 30 of the shoe 22.
3. Place the second end 36 of the elongated flexible strap 24 through the buckle 14.
4. Bend the elongated flexible strap 24 over, so that it will overlap a portion thereof.
5. Press the hook fastener material pad 54 against the loop pile fastener material pad 56.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A shoe fastening attachment device comprising:

a) a buckle, said buckle including long upper and lower segments and short side segments, said buckle being fabricated out of a strong durable metal material, said long lower segment of said buckle having a longitudinal track slot therein;

b) means for mounting said buckle to a pair of eyelets on a first side flap of a shoe, said buckle mounting means consisting of a pair of spaced apart hooks on said long lower segment of said buckle, whereby said hooks will fit into and engage with the pair of eyelets on the first side flap of the shoe;

c) an elongated flexible strap, said elongated flexible strap being rectangular and fabricated out of a cloth material;

d) means for mounting a first end of said elongated flexible strap to a pair of eyelets on an opposite second side flap of the shoe, said strap mounting means consisting of a pair of spaced apart couplers on the first end, whereby said couplers will fit into and engage with the pair of eyelets on the second side flap of the shoe; and e) means on an upper face of said elongated flexible strap for releasably securing portions of the upper face together, after a second end of said elongated flexible strap is inserted through said buckle and said elongated flexible strap is looped back upon itself in an overlapping manner, said releasably securing means including mating hook and loop pile fastener material pads affixed in a side by side arrangement on the upper face of an elongated flexible strip, and each said hook on said lower segment of said buckle having a disc-shaped head to ride in said track slot, so that each said hook can swivel and slide in an adjustable manner to make contact with the eyelets in different spaced apart relationships on the first side flap of the shoe.

* * * * *